US008614647B2

(12) United States Patent
Hotta et al.

(10) Patent No.: US 8,614,647 B2
(45) Date of Patent: Dec. 24, 2013

(54) ANTENNA DEVICE AND ELECTRONIC DEVICE INCLUDING ANTENNA DEVICE

(75) Inventors: Hiroyuki Hotta, Hamura (JP); Koichi Sato, Tachikawa (JP); Isao Ohba, Hachioji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 168 days.

(21) Appl. No.: 13/291,388

(22) Filed: Nov. 8, 2011

(65) Prior Publication Data

US 2012/0188134 A1 Jul. 26, 2012

(30) Foreign Application Priority Data

Jan. 25, 2011 (JP) ..... 2011-013007

(51) Int. Cl.
*H01Q 1/00* (2006.01)
*H01Q 1/38* (2006.01)

(52) U.S. Cl.
USPC ..... 343/722; 343/700 MS; 343/702

(58) Field of Classification Search
USPC ..... 343/700 MS, 702, 722, 749
See application file for complete search history.

(56) References Cited

U.S. PATENT DOCUMENTS

| | | | | |
|---|---|---|---|---|
| 6,903,688 | B2 * | 6/2005 | Edvardsson | 343/700 MS |
| 6,950,072 | B2 * | 9/2005 | Miyata et al. | 343/702 |
| 7,136,019 | B2 * | 11/2006 | Mikkola et al. | 343/702 |
| 7,982,678 | B2 * | 7/2011 | Hotta et al. | 343/702 |
| 2008/0169981 | A1 | 7/2008 | Hotta et al. | |
| 2011/0183633 | A1 | 7/2011 | Ohba et al. | |
| 2013/0050036 | A1 * | 2/2013 | Kashiwagi et al. | 343/749 |

FOREIGN PATENT DOCUMENTS

| | | |
|---|---|---|
| EP | 1 679 762 A1 | 7/2006 |
| JP | 2006-196994 | 7/2006 |
| JP | 2007-88975 | 4/2007 |
| JP | 2008-124617 | 5/2008 |
| JP | 2008-177678 | 7/2008 |
| JP | 2009-77225 | 4/2009 |
| JP | 2010-239246 | 10/2010 |
| WO | WO 2010/137061 A1 | 2/2010 |

OTHER PUBLICATIONS

The Extended European Search Report issued Mar. 28, 2012, in Europe Application No. / Patent No. 11186873.3-2220).
Office Action mailed Jan. 31, 2012 in Japanese Application No. 2011-013007 filed Jan. 25, 2011 (w/English translation).

* cited by examiner

*Primary Examiner* — Tan Ho
(74) *Attorney, Agent, or Firm* — Oblon, Spivak, McClelland, Maier & Neustadt, L.L.P.

(57) ABSTRACT

According to one embodiment, an antenna device includes a first element, a stub, and an open end element. The first element has a folded monopole structure in which a conductor is folded at a folding portion to form a forward portion and a backward portion. A base end of the forward portion is connected to a feeding point, and a distal end of the backward portion is connected to a ground via a first lumped parameter. The stub is provided between the forward portion and the backward portion of the first element so as to shunt the forward portion and the backward portion. The open end element includes a conductor placed in parallel to the first lumped parameter. A base end of the conductor is connected between the stub of the backward portion of the first element and the ground, and the distal end of the conductor is open.

18 Claims, 16 Drawing Sheets

<When position of stub is changed>

<When length of open end element is changed>

<When capacitance of open end element is changed>

Second resonant frequency

First resonant frequency

| | | STATE01 (capacitor or open) | STATE02 (inductor) | STATE03 (0Ω) |
|---|---|---|---|---|
| GSM | GSM850 : 824.7～897.4MHz | ○ | | |
| | EGSM : 880.2～959.8MHz | | | ○ |
| | DCS : 1710.2～1879.8MHz | | | ○ |
| | PCS : 1850.2～1989.8MHz | ○※ | | |
| W-CDMA | Band I : 1922.6～2167.4MHz | ○ | | |
| | Band VI : 832.4～882.6MHz | ○ | | |
| | Band VIII : 882.6～957.4 | | | ○ |
| CDMA2000 (JAPAN) | BC0 : 824.97～873.66MHz | ○ | | |
| | BC3 : 843.9～924.25MHz | | ○ | |
| | BC6 : 1928.75～2123.75MHz | ○ | | |
| CDMA2000 (US) | BC0 : 824.7～893.31MHz | ○ | | |
| | BC1 : 1851.25～1988.75MHz | ○※ | | |

※May be covered by STATE03

FIG. 15

When second element has folded structure (one distal end)

When folded in different manner

When two or more stubs are provided

When stub has plate-like design

When portion extending from stub has plate-like design

Second example with one distal end

First example with one distal end

When distal end portion is formed into a meandering design

When second element is folded

When distal end of second element is formed into a meandering design

When second element has folded structure

When second element has folded structure (with one or more stubs)

ANTENNA DEVICE AND ELECTRONIC DEVICE INCLUDING ANTENNA DEVICE

CROSS-REFERENCE TO RELATED APPLICATIONS

This application is based upon and claims the benefit of priority from prior Japanese Patent Application No. 2011-013007, filed Jan. 25, 2011, the entire contents of which are incorporated herein by reference.

FIELD

Embodiments described herein relate generally to an antenna device and an electronic device including the antenna device.

BACKGROUND

Recently, the housings of portable terminal devices typified by cellular phones, smart phones, personal digital assistants (PDAs), and tablet type terminals have been required to reduce the dimensions and weight from the viewpoint of compactness and light weightness. Accordingly, demands have arisen for more compact antenna devices. It has also been required to allow a single portable terminal device to communicate with a plurality of radio systems using different frequency bands.

Under the circumstances, for example, a folded monopole antenna has been proposed, which is obtained by folding the antenna element of a monopole antenna at a midway position so as to form a forward portion, a backward portion, and a ground point. There has also been proposed an antenna obtained by further folding the antenna element of this folded monopole antenna at a midway position. Using a multi-frequency folded monopole antenna using this folded structure can reduce a space required for mounting in a portable terminal device as compared with general folded antennas as well as general monopole antennas. Therefore, it can be expected to further reduce the sizes of portable terminal devices.

A folded monopole antenna using a folded structure obtains the first resonance in a frequency band in which the path length from the feeding point to the ground point through the forward and backward portions corresponds to almost ½ the wavelength of a general folded monopole antenna which does not use the folded structure, and the second resonance in a frequency band in which the path length from the feeding point to the ground point through the forward and backward portions corresponds to almost ⅔ the wavelength of the general folded monopole antenna. Of these resonant frequencies, the second resonant frequency may shift from the frequency band of a target radio system to result in a failure to communicate with the system.

A multi-frequency folded antenna has also been proposed, which is provided with the second antenna element in a direction opposite to the element direction of a folded monopole antenna. This type of antenna, however, is additionally provided with the second antenna element in the direction opposite to the monopole antenna element, and hence the total length of the antenna increases. This leads to an increase in the size of the antenna, which in turn becomes difficult to incorporate in a compact portable terminal device.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

FIG. 15 is a view for explaining specific applications of the antenna device shown FIG. 11 or 13;

DETAILED DESCRIPTION

Various embodiments will be described hereinafter with reference to the accompanying drawings.

In general, according to one embodiment, an antenna device includes a first antenna element, a stub, and an open end element. The first antenna element has a folded monopole structure in which a conductor is folded at a folding portion to form a forward portion and a backward portion. A base end of the forward portion is connected to a feeding point, and a distal end of the backward portion is connected to a ground point via a first lumped parameter circuit. The stub is provided between the forward portion and the backward portion of the first antenna element so as to shunt the forward portion and the backward portion. The open end element includes a conductor placed in parallel to the first lumped parameter circuit. A base end of the conductor is connected between the stub of the backward portion of the first antenna element and the ground point, and the distal end of the conductor is open. A electrical length from the feeding point of the first antenna element to the ground point is set in advance to a length equal to or near ½ the wavelength of the first resonant frequency. A electrical length from the feeding point to a distal end of the open end element via the forward portion of the first antenna element, the stub, and the backward portion of the first antenna element is set to a length equal to or near an integer multiple of ¼ the wavelength of the second resonant frequency.

First Embodiment

Figure 1:
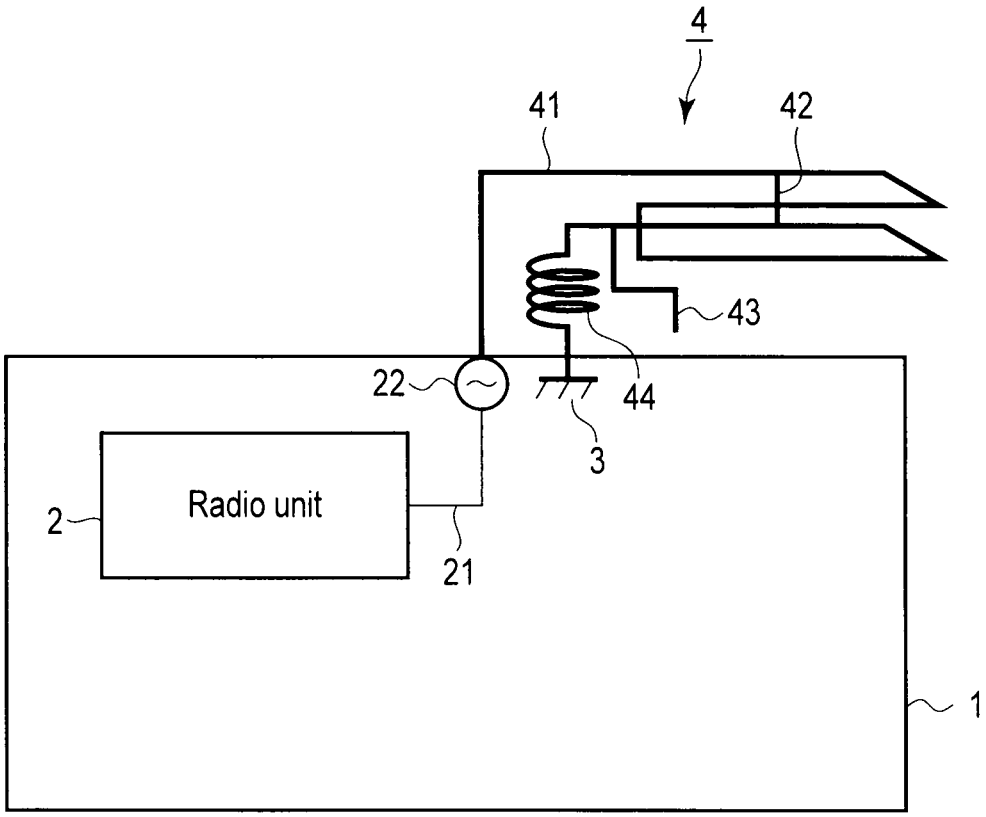
FIG. 1 is a view showing the arrangement of an electronic device including an antenna device according to the first embodiment.

FIG. 1 is a view showing the arrangement of an electronic device including an antenna device according to the first embodiment. This electronic device includes a portable terminal device such as a cellular phone, smart phone, or tablet type terminal. The housing (not shown) of this device accommodates a printed circuit board 1 and an antenna device 4. A plurality of circuit units necessary to form the portable terminal device are mounted on the printed circuit board 1. The circuit units include a radio unit 2. The radio unit 2 has a function of transmitting and receiving a radio signal having the same channel frequency as that used by a radio system as a communication target. A feeding point 22 is provided on the printed circuit board 1. The feeding point 22 is connected to the radio unit 2 via a feed line 21. A ground pattern 3 is provided on the printed circuit board 1.

The antenna device 4 has the following arrangement. The antenna device 4 includes a first antenna element 41, a stub 42, an open end element 43, and an inductor 44 as the first lumped parameter element.

The first antenna element 41 includes a folded monopole antenna using a folded structure. This folded monopole antenna using the folded structure is formed by folding a conducting wire at a folding portion, and further folding a pair of forward and backward portions of the conducting wire, formed by the above folding, at a midway position. The starting end of the forward portion is connected to the feeding point 22. The finishing end of a backward portion 12 is connected to the ground pattern (ground point) 3 on the printed circuit board 1 via the inductor 44.

The stub 42 is provided between the forward and backward portion of the first antenna element 41 so as to short-circuit the forward and backward portions.

The open end element 43 is placed in parallel to the inductor 44. The base end of the open end element 43 is connected between the stub 42 of the backward portion of the first antenna element 41 and the ground point 3. The distal end of the open end element 43 is open.

The electrical length from the feeding point 22 of the first antenna element 41 to the ground point 3 is set to ½ the wavelength of the first resonant frequency used by the first radio system as a communication target candidate. The electrical length from the feeding point 22 to the distal end of the open end element 43 via the forward portion of the first antenna element 41, the stub 42, and the backward portion of the first antenna element 41 is set to an integer multiple of ¼, preferably ¾, the wavelength of the second resonant frequency used by the second radio system as a communication target candidate.

With this arrangement, when performing communication with the first radio system, radio signals are transmitted and received by the first antenna element 41 whose electrical length is set to ½ the wavelength of the first resonant frequency. When performing communication with the second radio system, since the electrical length of the path including the stub 42 and the open end element 43 is set to ¾ the wavelength of the second resonant frequency, radio signals from the second radio system are transmitted and received via the path. That is, it is possible to perform wireless communication with the first and second radio systems by using the single antenna device obtained by combining the first antenna element 41, which has the folded monopole structure with the stub 42, and the open end element 43.

Example 1

Figure 2:
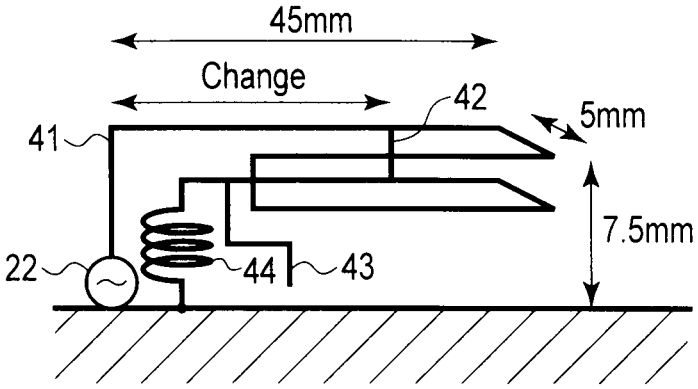
FIG. 2 is a view for explaining Example 1 of the antenna device shown in FIG. 1.

FIG. 2 shows the arrangement of Example 1 of the antenna device shown in FIG. 1. Referring to FIG. 2, the length from the feeding point 22 of the first antenna element 41 to the first folding position is set to 7.5 mm. The length from the first folding position to the next folding position is set to 45 mm. The distance between the forward and backward portions is set to 5 mm. The inductance of the inductor 44 is set to 12 nH. The size of the ground pattern is set to 160×100 mm.

Figure 3B:
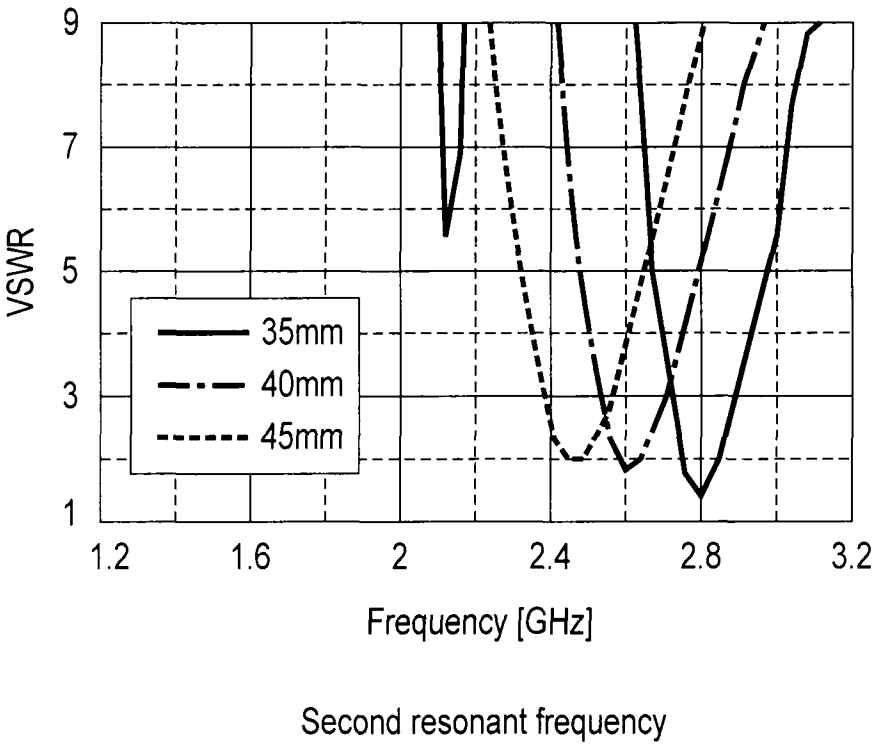
FIGS. 3A and 3B are graphs showing the VSWR frequency characteristics of the antenna device shown in FIG. 2.
Figure 3A:
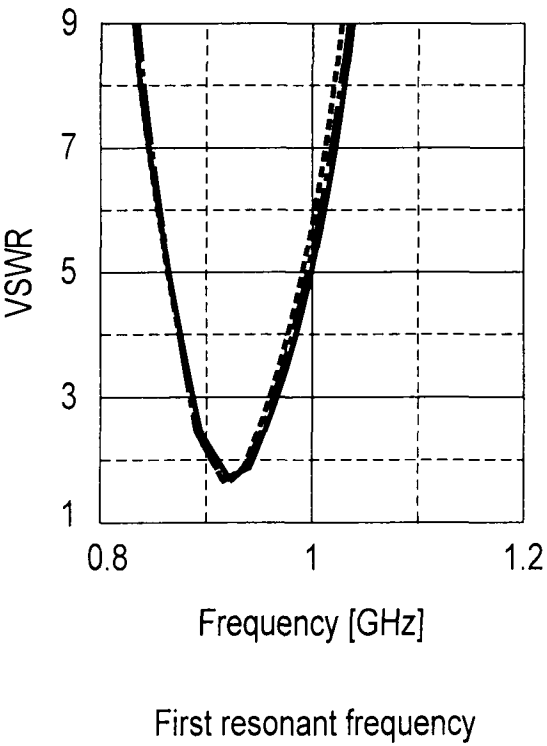

With this arrangement, setting the length from the first folding position of the first antenna element 41 to the stub 42 to 35 mm can set the second resonant frequency to 2.8 GHz as indicated by, for example, the voltage standing wave ratio (VSWR) frequency characteristics shown in FIGS. 3A and 3B. For reference, with the antenna obtained by removing the stub 42 and the open end element 43 from the antenna device shown in FIG. 2, the second resonant frequency shifts to near 2.2 GHz, and hence cannot be set to 2.8 GHz used by the second radio system as a target.

In the arrangement described in Example 1, changing the length from the first folding position of the first antenna element 41 to the stub 42 to 40 mm and 45 mm can variably set the second resonant frequency to 2.6 GHz and 2.45 GHz, respectively, without changing the first resonant frequency in the 800-MHz band, as indicated by the VSWR frequency characteristics in FIGS. 3A and 3B.

Example 2

Figure 4:
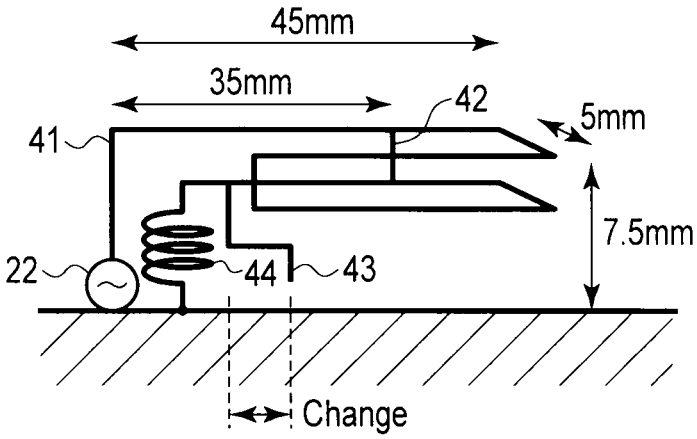
FIG. 4 is a view for explaining Example 2 of the antenna device shown in FIG. 1.

FIG. 4 shows Example 2 of the antenna device shown in FIG. 1, in which the length of each portion of the first antenna element 41, the inductance of the inductor 44, and the size of the ground point 3 are set to the same values as those in Example 1.

In this arrangement, setting the element length of the open end element 43 to 2.5 mm can set the second resonant frequency to 2.8 GHz as indicated by, for example, the VSWR frequency characteristics in FIG. 5. For reference, with the antenna obtained by removing the stub 42 and the open end element 43 from the antenna device shown in FIG. 4, the second resonant frequency shifts to near 2.2 GHz, and hence cannot be set to 2.8 GHz used by the second radio system as a target.

Figure 5B:
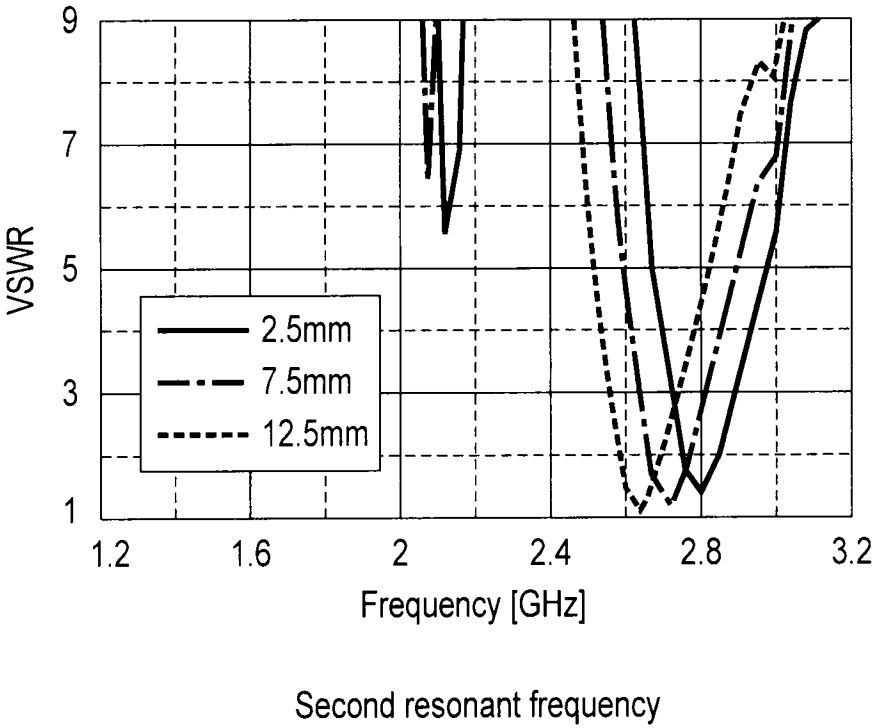
FIGS. 5A and 5B are graphs showing the VSWR frequency characteristics of the antenna device shown in FIG. 4.
Figure 5A:
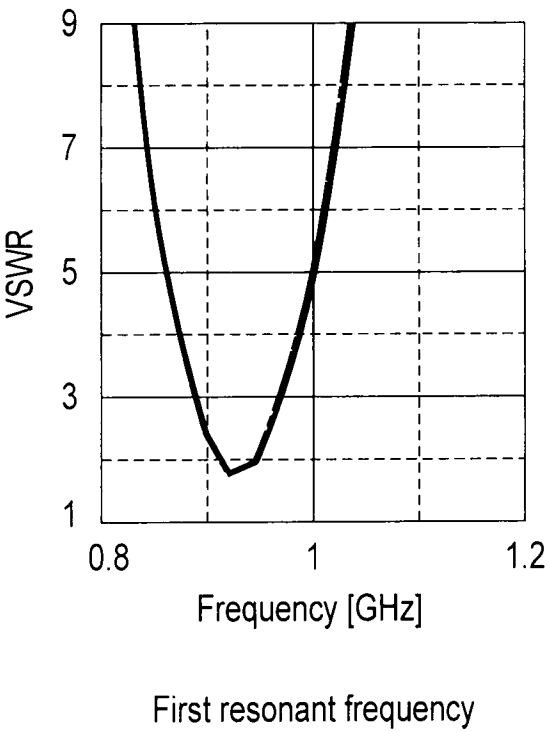

In the arrangement described in Example 2, changing the element length of the open end element 43 to, for example, 7.5 mm and 12.5 mm can variably set the second resonant frequency to 2.7 GHz and 2.65 GHz, respectively, without changing the first resonant frequency in the 800-MHz band, as indicated by the VSWR frequency characteristics in FIGS. 5A and 5B.

As described in detail above, the first embodiment forms the antenna device by combining the open end element 43 with the first antenna element 41 having the folded monopole structure with the stub 42. The electrical length from the feeding point 22 of the first antenna element 41 to the ground point 3 is set to ½ the wavelength of the first resonant frequency used by the first radio system as a communication target candidate. The electrical length from the feeding point 22 to the distal end of the open end element 43 via the forward portion of the first antenna element 41, the stub 42, and the backward portion of the first antenna element 41 is set to ¾ the wavelength of the second resonant frequency used by the second radio system as a communication target candidate.

It is therefore possible to set the first and second resonant frequencies to both the frequencies used by the first and second radio systems without increasing the size of the first antenna element 41 in the axial direction.

It is also possible to variably set the second resonant frequency without changing the first resonant frequency by arbitrarily setting the length from the first folding position of the first antenna element 41 to the stub 42 or the element length of the open end element 43.

(Modification)

Figure 6:
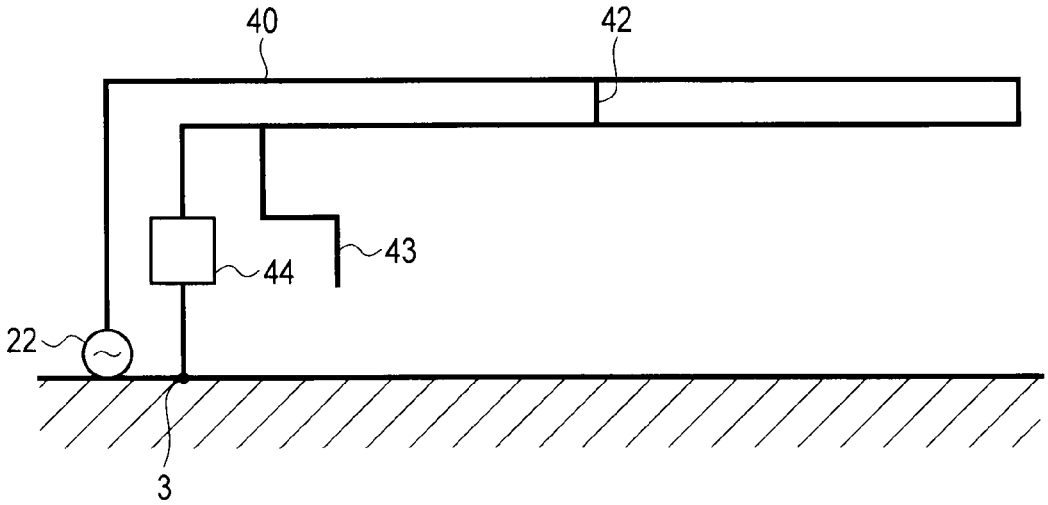
FIG. 6 is a view for explaining a modification of the antenna device shown in FIG. 1.

FIG. 6 shows a modification of the antenna device shown in FIG. 1.

In this modification, the first antenna element 40 has a monopole structure obtained by simply folding the antenna element once, instead of using a folded structure. Note that this arrangement is the same as that shown in FIG. 1 in that the open end element 43 is placed in parallel to the inductor 44, and the base end of the open end element 43 is connected between the ground point 3 and the stub 42 of the backward portion of the first antenna element 40.

With this arrangement, although the element length of the first antenna element 40 is longer than that in the arrangement shown in FIG. 1, it is possible to variably set the second resonant frequency without changing the first resonant frequency by arbitrarily setting the length from the first folding position of the first antenna element 41 to the stub 42 or the element length of the open end element 43.

Second Embodiment

Figure 7:
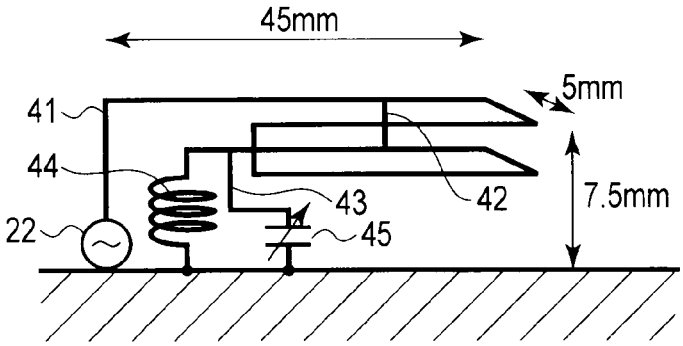
FIG. 7 is a view showing the arrangement of an antenna device according to the second embodiment.

FIG. 7 is a view showing the arrangement of an antenna device according to the second embodiment. The same reference numbers as in FIG. 7 denote the same parts in FIGS. 2 and 4, and a detailed description of them will be omitted.

Referring to FIG. 7, a variable capacitor 45 as the second lumped parameter element is connected between the distal end of an open end element 43 and a ground point 3. The capacitance of the variable capacitor 45 is variably controlled by, for example, control signals output from a control unit (not shown) mounted on the printed circuit board 1.

Figure 8B:
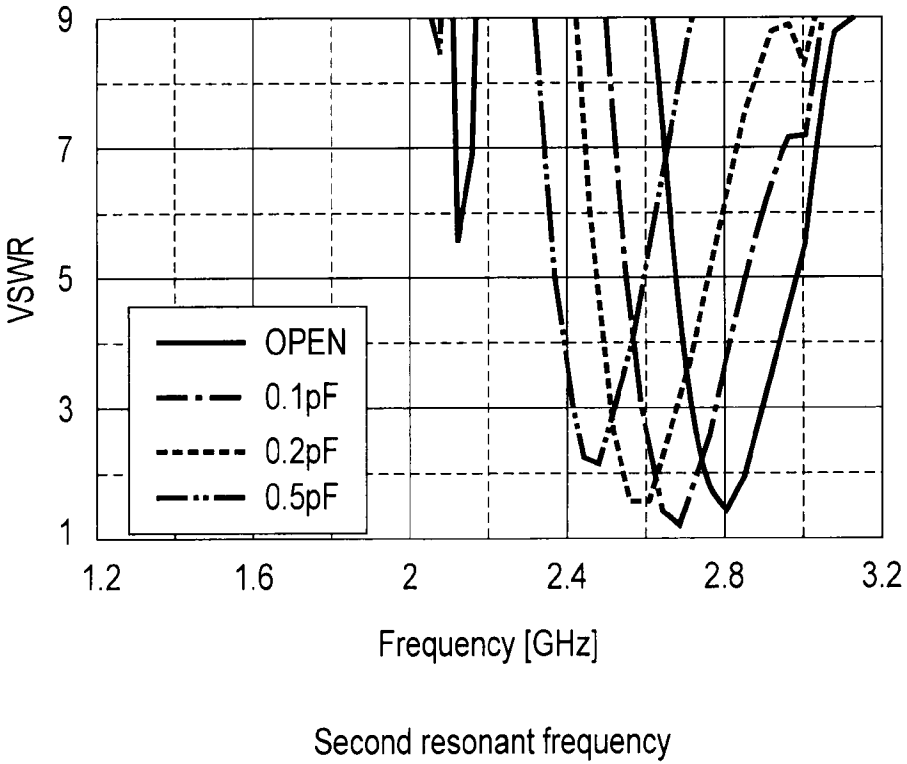
FIGS. 8A and 8B are graphs showing the VSWR frequency characteristics of the antenna device shown in FIG. 7.
Figure 8A:
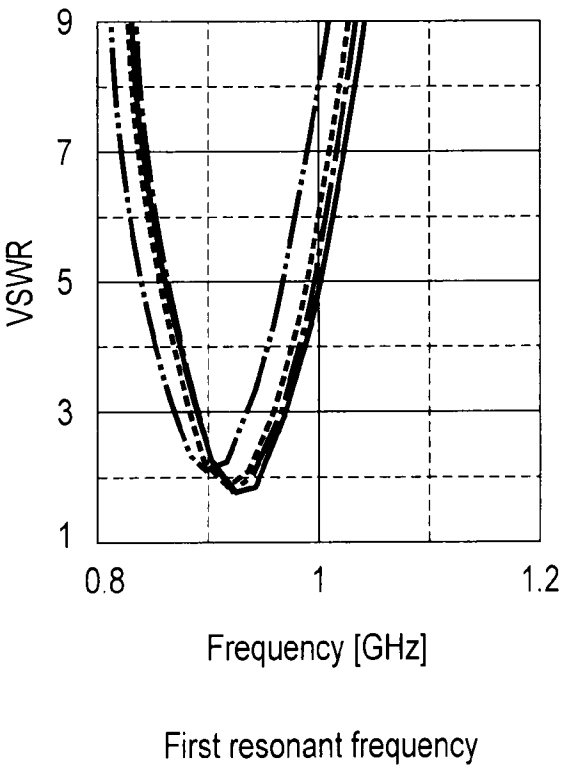

With this arrangement, variably changing the capacitance of the variable capacitor 45 can variably set the first and second resonant frequencies. If, for example, the capacitance of the variable capacitor 45 is variably set to 0.1 pF, 0.2 pF, and 0.5 pF, the first resonant frequency in the 800-MHz band and the second resonant frequency in the 2-GHz band change as indicated by the VSWR frequency characteristics in FIGS. 8A and 8B. In this case, although the change in the first resonant frequency in the 800-MHz band is slight, the second resonant frequency in the 2-GHz band can be changed at, for example, 400-MHz intervals.

Third Embodiment

Figure 9:
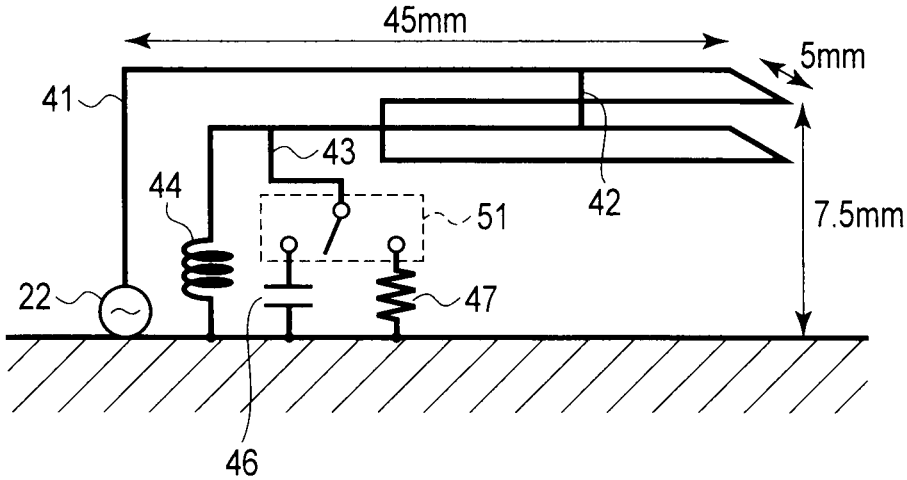
FIG. 9 is a view showing the arrangement of an antenna device according to the third embodiment.

FIG. 9 is a view showing the arrangement of an antenna device according to the third embodiment. The same reference numbers as in FIG. 9 denote the same parts in FIGS. 2 and 4, and a detailed description of them will be omitted.

Referring to FIG. 9, one terminal of each of a capacitor 46 and 0Ω resistor 47 as a plurality of lumped parameter elements is connected to a ground point 3. An SPDT switch 51 is provided between the distal end of an open end element 43 and the other terminal of each of the capacitor 46 and 0Ω resistor 47. The SPDT switch 51 includes a switch having one movable contact and two fixed contacts. For example, this switch performs switching operation so as to connect the movable contact to one of the two fixed contacts in accordance with a switching control signal output from a control unit (not shown) mounted on the printed circuit board 1. With this switching operation, the SPDT switch 51 connects one of the capacitor 46 and the 0Ω resistor 47 between the ground point 3 and the distal end of the open end element 43.

With this arrangement, assume that, at the time of shipment, in accordance with the list of data shown in FIG. 15, the operator has input, to the control unit, commands to select, as the first radio system, "GSM® 850", "Band VI of W-CDMA", "BC0 of CDMA 2000 (JAPAN)", or "BC0 of CDMA 2000 (US)" and to select, as the second radio communication system, "PCS of GSM", "Band I of W-CDMA", "BC6 of CDMA 2000 (JAPAN)", or "BC1 of CDMA 2000 (US)".

Figure 10B:
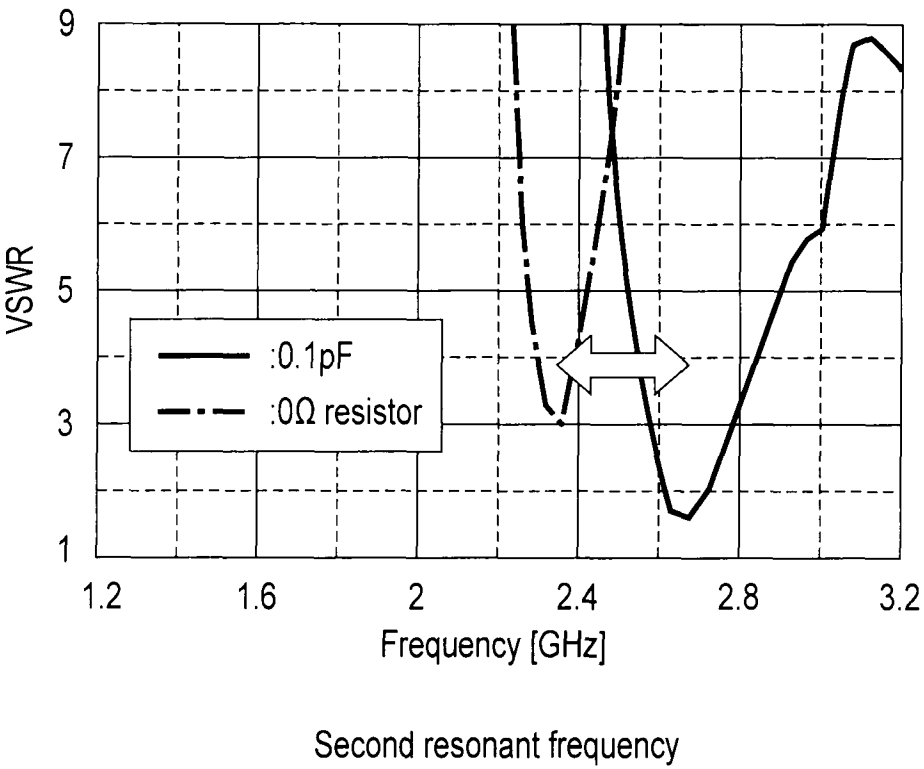
FIGS. 10A and 10B are graphs showing the VSWR frequency characteristics of the antenna device shown in FIG. 9.
Figure 10A:
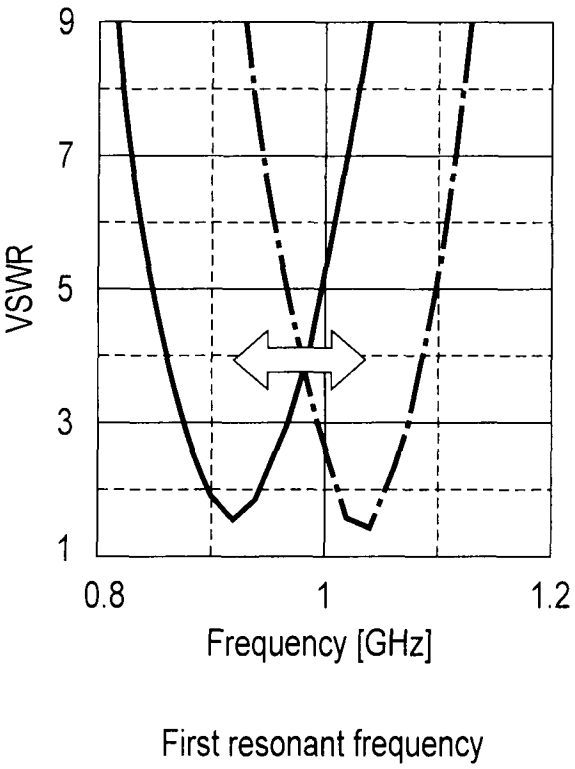

The control unit then outputs a switching control signal to the SPDT switch 51 to select the capacitor 46. This makes the SPDT switch 51 switch to the capacitor 46 side. As a result, the capacitor 46 is connected between the ground point 3 and the distal end of the open end element 43. Assume that the capacitance of the capacitor 46 is set to 0.1 pF. In this case, the first and second resonant frequencies are respectively set to the frequencies indicated by the solid lines representing the VSWR frequency characteristics in FIGS. 10A and 10B, thereby allowing to communicate with the selected first and second radio communication systems.

Note that it is possible to variably set the capacitance of the variable capacitor 45 under the control of the control unit by using the variable capacitor 45 instead of the capacitor 46, as described in the second embodiment. This makes it possible to further accurately tune the first and second resonant frequencies in accordance with the operating frequencies of radio communication systems as targets.

In contrast, assume that in accordance with the list of data shown in FIG. 15, the operator has input commands to the control unit to select, as the first radio communication system, "EGSM" or "Band VIII of W-CDMA" and to select, as the second radio communication system, "DCS of GSM". The control unit then outputs a switching control signal to the SPDT switch 51 to select the 0Ω resistor 47. This makes the SPDT switch 51 switch to the 0Ω resistor 47 side. As a result, the 0Ω resistor 47 is connected between the ground point 3 and the distal end of the open end element 43. In this case, therefore, the first and second resonant frequencies are set to the frequencies indicted by the one-dot dashed lines in FIGS. 10A and 10B. This allows communication with the selected first and second radio communication systems.

According to the third embodiment described above, it is possible to simultaneously change and set both the first and second resonant frequencies of the antenna device by inputting selection commands corresponding to a pair of radio communication systems to be used. In addition, it is possible to change each of the above resonant frequencies by switching operation of one SPDT switch 51. This makes it possible to implement a simple compact circuit arrangement as compared with the case in which a plurality of discrete switches are provided to selectively connect a plurality of lumped parameter elements.

Fourth Embodiment

Figure 11:
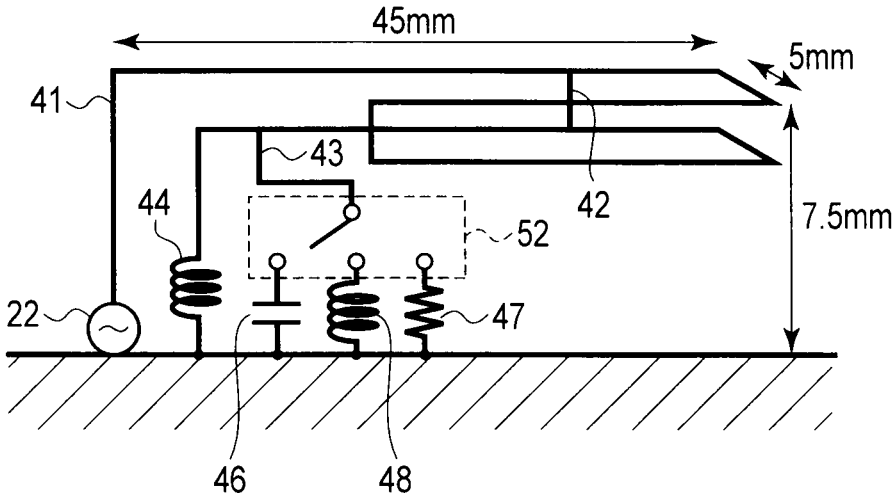
FIG. 11 is a view showing the arrangement of an antenna device according to the fourth embodiment.

FIG. 11 is a view showing the concrete arrangement of an antenna device according to the fourth embodiment. The same reference numbers as in FIG. 11 denote the same parts in FIGS. 2 and 4, and a detailed description of them will be omitted.

Referring to FIG. 11, one terminal of each of a capacitor 46, a 0Ω resistor 47, and an inductor 48 is connected to a ground point 3. An SPDT switch 52 is connected between the distal end of an open end element 43 and the other terminal of each of the capacitor 46, 0Ω resistor 47, and inductor 48. The SPDT switch 52 includes a switch having one movable contact and three fixed contacts. Like the third embodiment, for example, this switch performs switching operation so as to connect the movable contact to one of the three fixed contacts in accordance with a switching control signal output from a control unit (not shown) mounted on a printed circuit board 1. With this switching operation, the SPDT switch 52 connects one of the capacitor 46, the 0Ω resistor 47, and the inductor 48 between the ground point 3 and the distal end of the open end element 43.

With this arrangement, assume that, at the time of shipment, in accordance with the list of data shown in FIG. 15, the operator has input, to the control unit, commands to select, as the first radio communication system, "GSM 850", "Band VI of W-CDMA", "BC0 of CDMA 2000 (JAPAN)", or "BC0 of CDMA 2000 (US)" and to select, as the second radio communication system, "PCS of GSM", "Band I of W-CDMA", "BC6 of CDMA 2000 (JAPAN)", or "BC1 of CDMA 2000 (US)".

Figure 12B:
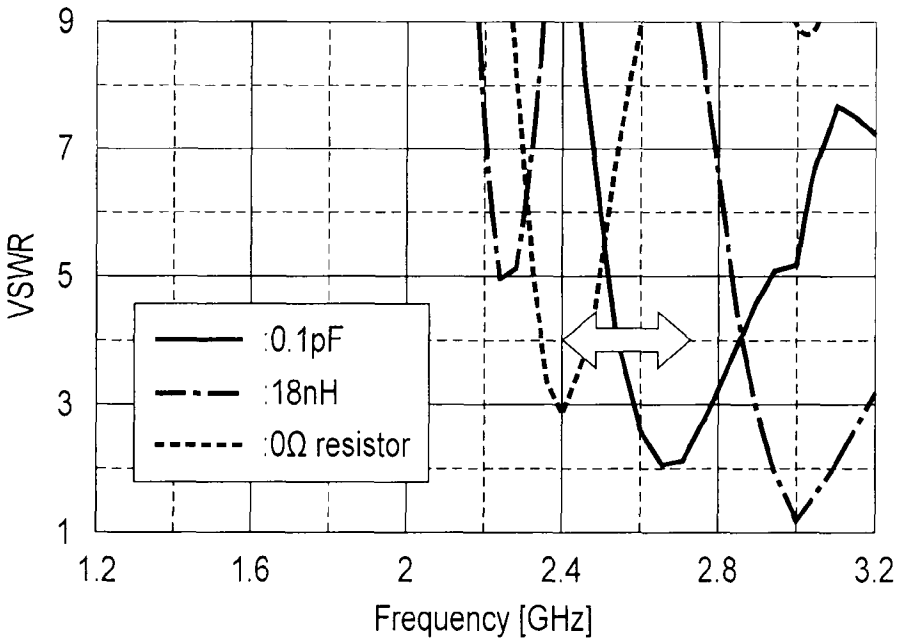
FIGS. 12A and 12B are graphs showing the VSWR frequency characteristics of the antenna device shown in FIG. 11.
Figure 12A:
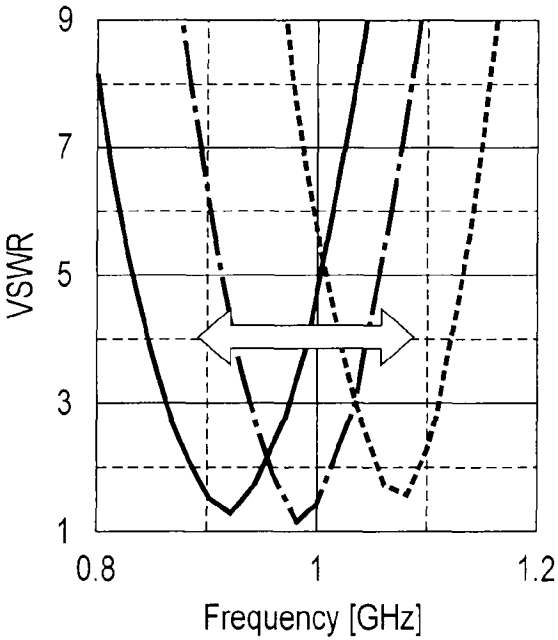

The control unit then outputs a switching control signal to the SPDT switch 52 to select the capacitor 46. This makes the SPDT switch 52 switch to the capacitor 46 side. As a result, the capacitor 46 is connected between the ground point 3 and the distal end of the open end element 43. Assume that the capacitance of the capacitor 46 is set to 0.1 pF. In this case, the first and second resonant frequencies are respectively set to the frequencies indicated by the solid lines representing the VSWR frequency characteristics in FIGS. 12A and 12B, thereby allowing to communicate with the selected first and second radio communication systems.

Note that it is possible to variably set the capacitance of the variable capacitor 45 under the control of the control unit by using the variable capacitor 45 instead of the capacitor 46, as described in the second embodiment. This makes it possible to further accurately tune the first and second resonant frequencies in accordance with the operating frequencies of radio communication systems as targets.

In contrast, assume that in accordance with the list of data shown in FIG. 15, the operator has input commands to the control unit to select, as the first radio communication system, "EGSM" or "Band VIII of W-CDMA" and to select, as the second radio communication system, "DCS of GSM". The control unit then outputs a switching control signal to the SPDT switch 52 to select the 0Ω resistor 47. This makes the SPDT switch 52 switch to the 0Ω resistor 47 side. As a result, the 0Ω resistor 47 is connected between the ground point 3 and the distal end of the open end element 43. In this case, therefore, the first and second resonant frequencies are set to the frequencies indicted by the broken lines in FIGS. 12A and 12B. This allows communication with the selected first and second radio communication systems.

Assume that in accordance with the list of data shown in FIG. 15, the operator has input a command to the control unit to select "BC3 of CDMA 2000 (JAPAN)" as the first radio communication system. The control unit then outputs a switching control signal to the SPDT switch 52 to select the inductor 48. This makes the SPDT switch 52 switch to the inductor 48 side. As a result, the inductor 48 is connected between the ground point 3 and the distal end of the open end element 43. In this case, therefore, the first and second resonant frequencies are set to the frequencies indicted by the one-dot dashed lines representing the VSWR frequency characteristics in FIGS. 12A and 12B. This allows communication with the selected first radio communication system.

According to the fourth embodiment described above, it is possible to simultaneously change and set both the first and second resonant frequencies of the antenna device by inputting selection commands corresponding to a pair of radio communication systems to be used. In addition, it is possible to change each of the above resonant frequencies by switching operation of one SPDT switch 52. This makes it possible to implement a simple compact circuit arrangement as compared with the case in which a plurality of discrete switches are provided to selectively connect a plurality of lumped parameter elements.

Fifth Embodiment

Figure 13:
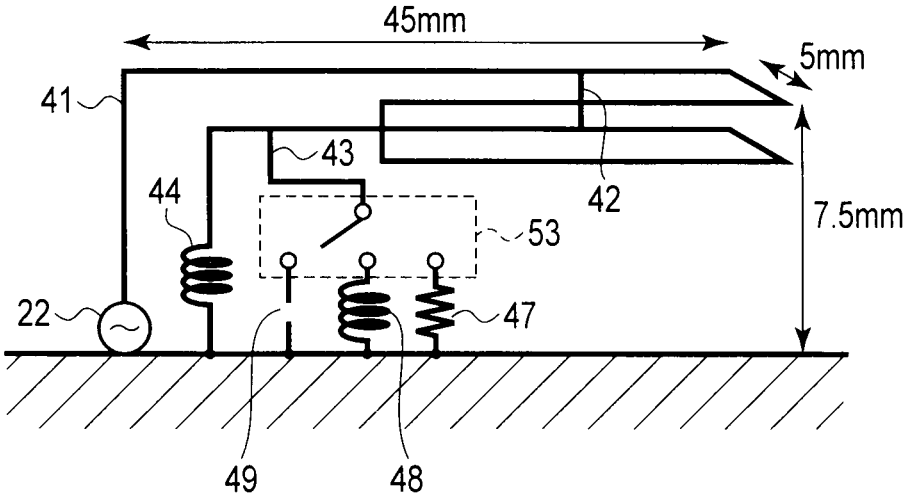
FIG. 13 is a view showing the arrangement of an antenna device according to the fifth embodiment.

FIG. 13 is a view showing the concrete arrangement of an antenna device according to the fifth embodiment. The same reference numbers as in FIG. 13 denote the same parts in FIGS. 2 and 4, and a detailed description of them will be omitted.

Referring to FIG. 13, one terminal of each of an open circuit 49, a 0Ω resistor 47, and an inductor 48 as a plurality of lumped parameter elements is connected to a ground point 3. An SPDT switch 53 is connected between the distal end of an open end element 43 and the other terminal of each of the open circuit 49, 0Ω resistor 47, and inductor 48. The SPDT switch 53 includes a switch having one movable contact and three fixed contacts. Like the fourth embodiment, for example, this switch performs switching operation so as to connect the movable contact to one of the three fixed contacts in accordance with, for example, a switching control signal output from a control unit (not shown) mounted on a printed circuit board 1. With this switching operation, the SPDT switch 53 connects one of the open circuit 49, the 0Ω resistor 47, and the inductor 48 between the ground point 3 and the distal end of the open end element 43.

With this arrangement, assume that, at the time of shipment, in accordance with the list of data shown in FIG. 15, the operator has input, to the control unit, commands to select, as the first radio communication system, "GSM 850", "Band VI of W-CDMA", "BC0 of CDMA 2000 (JAPAN)", or "BC0 of CDMA 2000 (US)" and to select, as the second radio communication system, "PCS of GSM", "Band I of W-CDMA", "BC6 of CDMA 2000 (JAPAN)", or "BC1 of CDMA 2000 (US)".

Figure 14B:
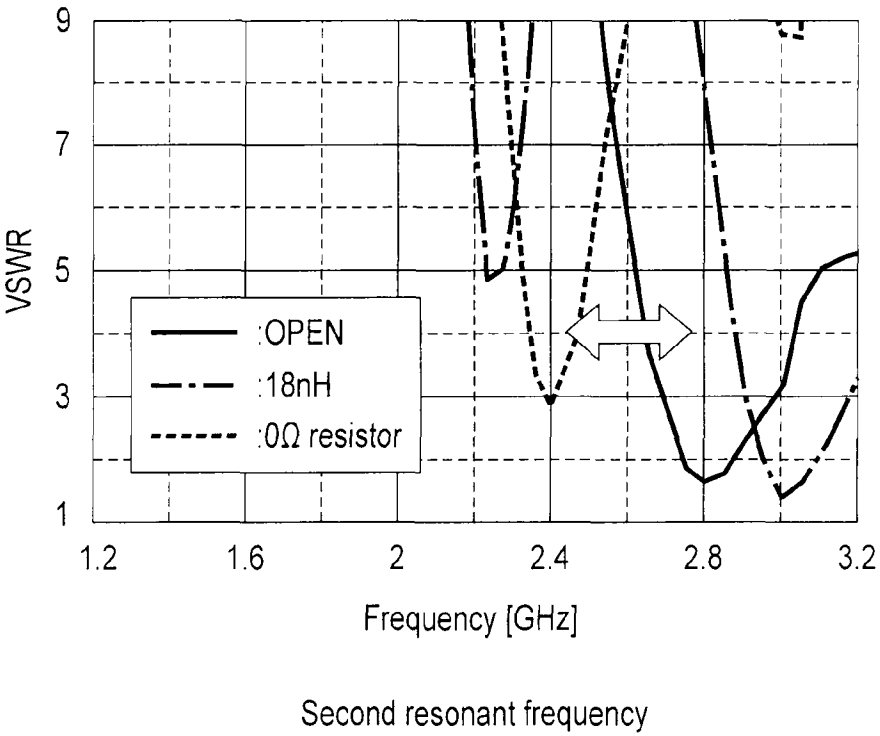
FIGS. 14A and 14B are graphs showing the VSWR frequency characteristics of the antenna device shown in FIG. 13.
Figure 14A:
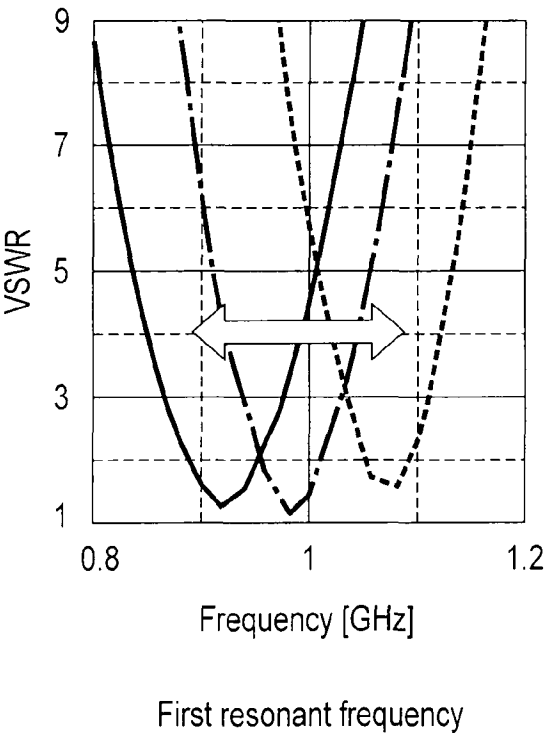

The control unit then outputs a switching control signal to the SPDT switch 53 to select the open circuit 49. This makes the SPDT switch 53 switch to the open circuit 49 side. As a result, the distal end of the open end element 43 becomes an open end. Therefore, the first and second resonant frequencies are respectively set to the frequencies indicated by the solid lines representing the VSWR frequency characteristics in FIGS. 14A and 14B, thereby allowing to communicate with the selected first and second radio communication systems.

In contrast, assume that in accordance with the list of data shown in FIG. 15, the operator has input commands to the control unit to select, as the first radio communication system, "EGSM" or "Band VIII of W-CDMA" and to select, as the second radio communication system, "DCS of GSM". The control unit then outputs a switching control signal to the SPDT switch 53 to select the 0Ω resistor 47. This makes the SPDT switch 53 switch to the 0Ω resistor 47 side. As a result, the 0Ω resistor 47 is connected between the ground point 3 and the distal end of the open end element 43. In this case, therefore, the first and second resonant frequencies are set to the frequencies indicted by the broken lines in FIGS. 14A and 14B. This allows communication with the selected first and second radio communication systems.

Assume that in accordance with the list of data shown in FIG. 15, the operator has input a command to the control unit to select "BC3 of CDMA 2000 (JAPAN)" as the first radio communication system. The control unit then outputs a switching control signal to the SPDT switch 53 to select the inductor 48. This makes the SPDT switch 53 switch to the inductor 48 side. As a result, the inductor 48 is connected between the ground point 3 and the distal end of the open end element 43. In this case, therefore, the first and second resonant frequencies are set to the frequencies indicated by the VSWR frequency characteristics in FIGS. 14A and 14B. This allows communication with the selected first radio communication system.

According to the fifth embodiment described above as well, it is possible to simultaneously change and set both the first and second resonant frequencies of the antenna device by inputting selection commands corresponding to a pair of radio communication systems to be used. In addition, it is possible to change each of the above resonant frequencies by switching operation of one SPDT switch 53. This makes it possible to implement a simple compact circuit arrangement as compared with the case in which a plurality of discrete switches are provided to selectively connect a plurality of lumped parameter elements.

Sixth Embodiment

Figure 16:
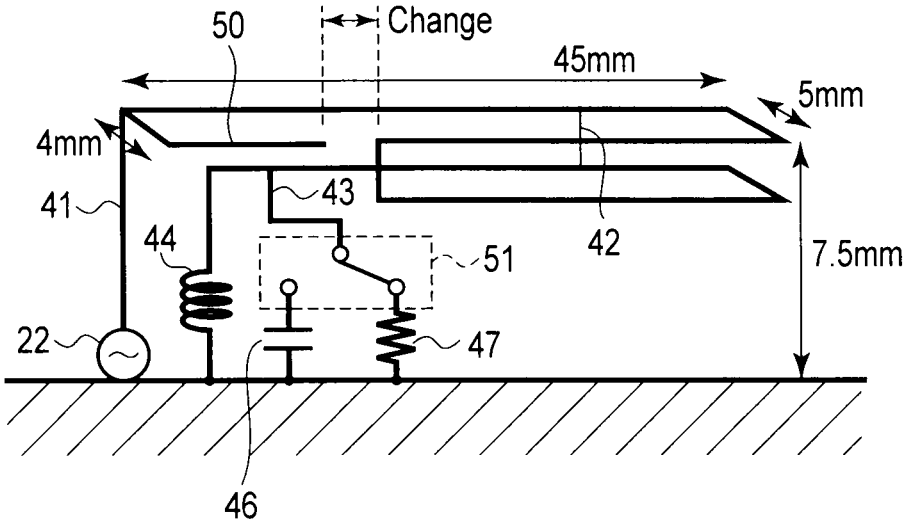
FIG. 16 is a view showing the arrangement of an antenna device according to the sixth embodiment.

FIG. 16 is a view showing the concrete arrangement of an antenna device according to the sixth embodiment. The same reference numbers as in FIG. 16 denote the same parts in FIG. 9, and a detailed description of them will be omitted.

In addition to the arrangement of the apparatus described in the fourth embodiment, the antenna device according to the sixth embodiment includes a second antenna element 50. As shown in FIG. 16, the conducting body of the second antenna element 50 is placed in parallel to the forward portion of a first antenna element 41, and the base end of the conducting body is connected between a stub 42 and a feeding point 22 of the forward portion of the first antenna element, while the distal end of the conducting body is open. The element length of the second antenna element 50 is set such that the distance between the distal end of the second antenna element 50 and the folding portion of the first antenna element 41 becomes 1/60 or less the wavelength of the second resonant frequency.

Figure 17B:
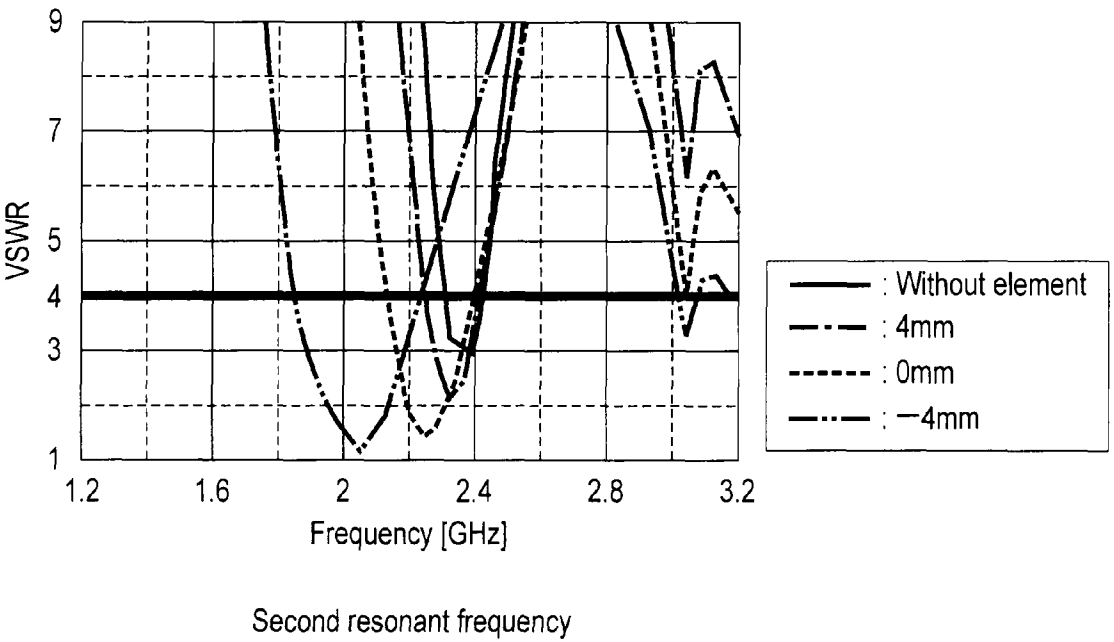
FIGS. 17A and 17B are graphs showing the VSWR frequency characteristics of the antenna device shown in FIG. 16.
Figure 17A:
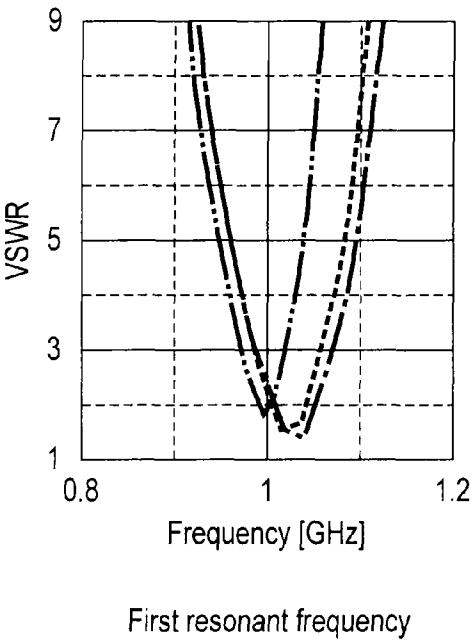

Providing the second antenna element 50 can increase the bandwidth of the second resonant frequency without increasing the size of the first antenna element 41 in the element direction. If, for example, the distance between the distal end of the second antenna element 50 and the folding portion of the first antenna element 41 is set to 4 mm, 0 mm, and −4 mm, the VSWR frequency characteristics of the second resonant frequency become those indicated by the one-dot dashed line, broken line, and two-dot dashed line shown in FIG. 17. That is, in each case, the bandwidth at VSWR=4 can be increased twice or more as compared with the VSWR frequency characteristics of the second resonant frequency without the second antenna element 50 (FIGS. 17A and 17B).

Other Embodiments

In the first embodiment, the antenna device shown in FIG. 1 can be variously modified as follows.

Figure 18A:
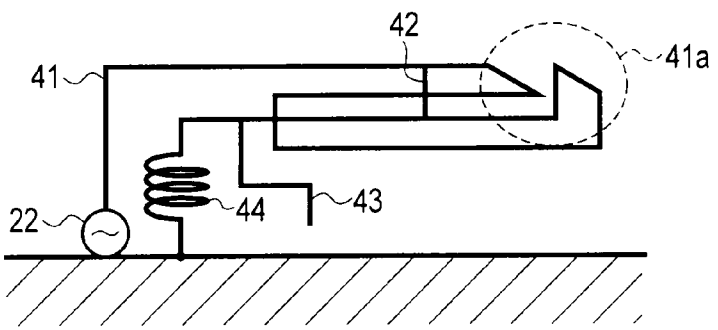
FIGS. 18A, 18B, 18C, and 18D are views for explaining other different first modifications of the antenna device shown in FIG. 1.
Figure 18B:
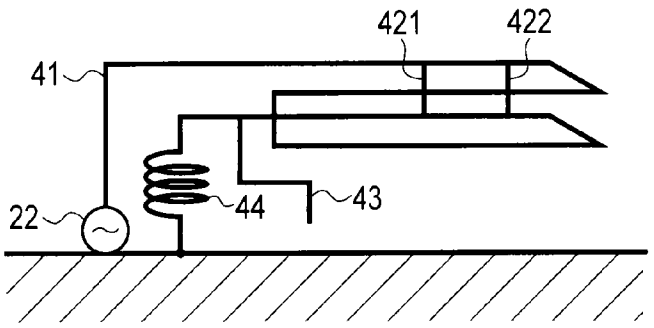
Figure 18C:
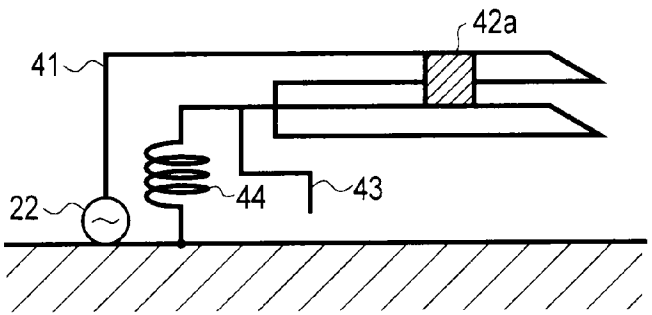
Figure 18D:
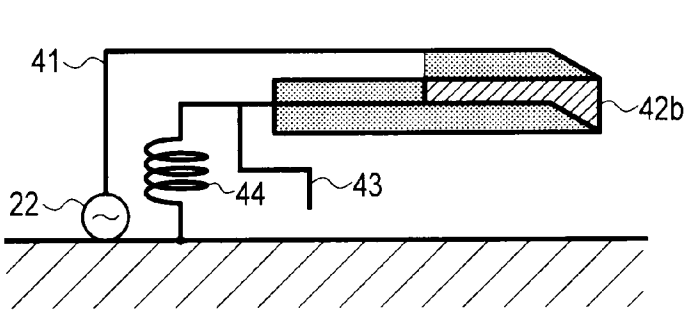

FIGS. 18A, 18B, 18C, and 18D show the first modifications of the antenna device. FIG. 18A shows the device obtained by folding the first antenna element 41 into a different design. FIG. 18B shows the device obtained by providing a plurality of (two in FIG. 18B) stubs 421 and 422 between the forward and backward portions of the first antenna element 41. FIG. 18C shows the device obtained by providing a stub 42*a* having a plate-like design. FIG. 18D shows the device obtained by forming the portion extending from a stub 42*b* of the first antenna element 41 into a plate-like design.

Figure 19B:
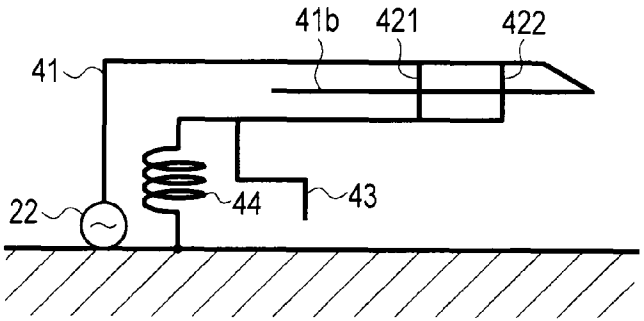
FIGS. 19A, 19B, and 19C are views for explaining other different second modifications of the antenna device shown in FIG. 1.
Figure 19A:
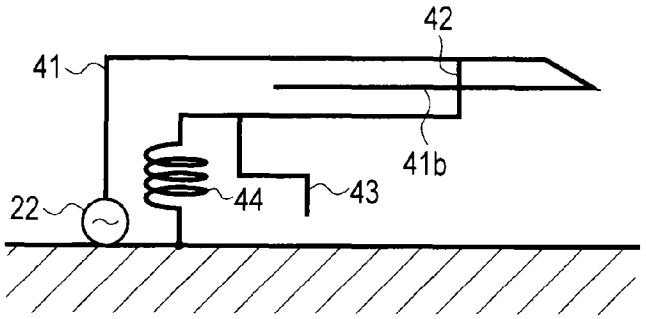
Figure 19C:
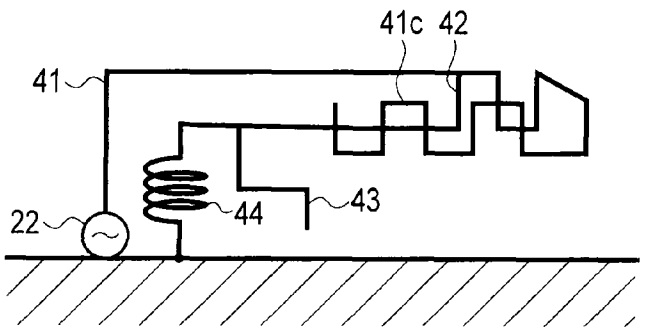

FIGS. 19A, 19B, and 19C show the second modifications of the antenna device. FIG. 19A shows the device in which the forward and backward portions of the first antenna element 41 which extend from the installation position of the stub 42 are formed by one conducting wire. FIG. 19B shows the device including a plurality of stubs 421 and 422 between the forward and backward portions of the first antenna element 41, with forward and backward portions extending from the installation positions of the stubs 421 and 422 being formed by one conducting wire. FIG. 19C shows the device in which the conducting wire of the first antenna element 41 which extends from the installation position of the stub 42 is formed into a meandering design.

Figure 21:
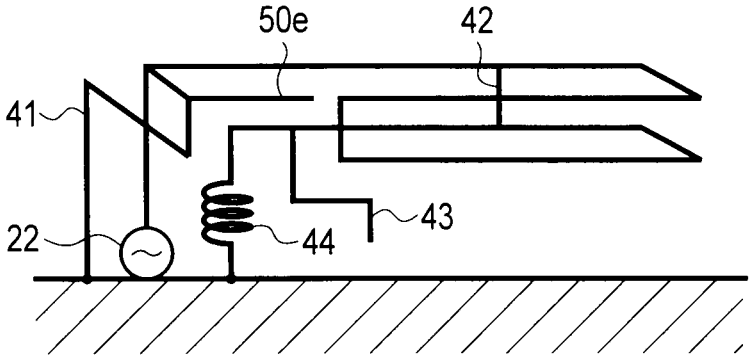
FIG. 21 is a view for explaining another modification of the antenna device shown in FIG. 16.
Figure 20A:
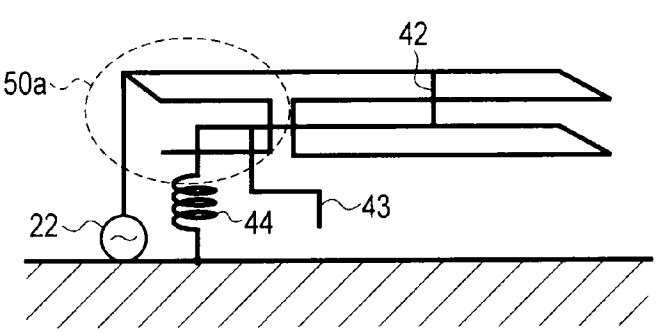
FIGS. 20A, 20B, 20C, and 20D are views for explaining still other different first modifications of the antenna device shown in FIG. 16.
Figure 20B:
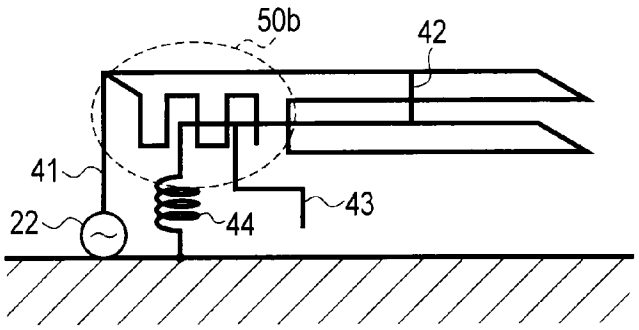
Figure 20C:
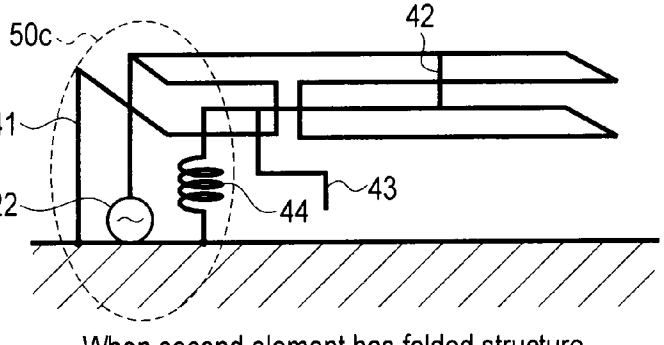
Figure 20D:
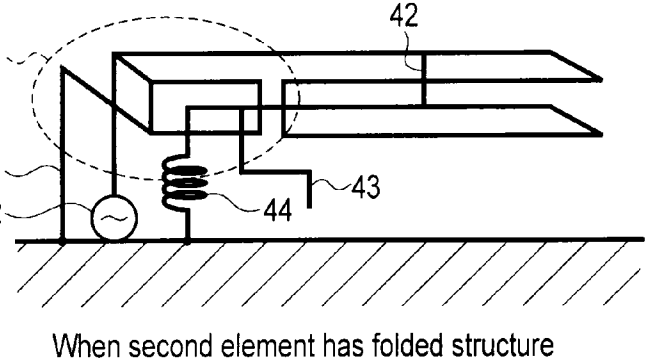

FIGS. 20A, 20B, 20C, and 20D show modifications of the antenna device additionally including the second antenna element 50 according to the sixth embodiment shown in FIG. 16. FIG. 20A shows the device obtained by folding a second antenna element 50*a* parallelly to the first antenna element 41. FIG. 20B shows the device obtained by forming the distal end of a second antenna element 50*b* into a meandering design. FIG. 20C shows the device obtained by folding a second antenna element 50*c* and grounding its distal end near the feeding point 22. FIG. 20D shows the device obtained by making a second antenna element 50*c* have a folded structure and providing a stub between the forward and backward portions formed by folding the antenna element. FIG. 21 shows the device obtained by making a second antenna element 50*e* have a folded structure and forming the portion extending from a stub by using one conducting wire.

In addition, the present embodiments can be carried out with various modifications associated with the type of radio communication system as an application target, its frequency band, the type and arrangement of electronic device in which the antenna device is to be mounted, the designs of elements constituting the antenna device, the type and arrangement of switching circuit, and the sizes of elements constituting the antenna device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

a folded monopole antenna comprising a forward portion and a backward portion, with an end of the forward portion being connected to a feeding point and an end of the backward portion being connected to a ground point via a first lumped parameter circuit;

a stub provided between the forward portion and the backward portion and configured to shunt the forward portion and the backward portion; and a conductor in parallel to the first lumped parameter circuit and comprising a first end and a second end, with the first end being connected between the stub and the ground point, and the second end being open;

wherein an electrical length from the feeding point to the ground point via the folded monopole antenna is equal to or near ½ a wavelength of a first resonant frequency, and an electrical length from the feeding point to the second end of the conductor via the forward portion, the stub, and the backward portion is equal to or near an integer multiple of ¼ a wavelength of a second resonant frequency.

2. The device of claim 1, wherein each of the forward portion and backward portion is folded.

3. The device of claim 1, further comprising:

a second lumped parameter circuit connected between the ground point and the second end of the conductor.

4. The device of claim 3, wherein an impedance of the second lumped parameter circuit is variable.

5. The device of claim 1, further comprising:

lumped parameter elements; and a switching circuit between the ground point and the second end of the conductor in order to selectively connect the lumped parameter elements.

6. The device of claim 5, wherein each of the lumped parameter elements comprises at least two of a capacitor, an inductor, a 0Ω resistor, and an open circuit.

7. The device of claim 5, wherein each of the lumped parameter elements comprises at least a first element and a second element wherein the first element and the second element are different.

8. The device of claim 1, further comprising:

a second antenna element comprising one end and another end, wherein the one end is connected between the stub and the ground point, and the other end is open near the folded monopole antenna.

9. The device of claim 8, wherein the second antenna element is placed such that a distance between the other end and a connection point between the forward portion and the backward portion is not more than 1/60 the wavelength of the second resonant frequency.

10. An electronic device comprising:

a radio circuit configured to transmit and receive a radio signal; and an antenna device connected to the radio circuit and a ground point, the antenna device including:

a folded monopole antenna comprising a forward portion and a backward portion, with an end of the forward portion being connected to a feeding point and an end of the backward portion being connected to the ground point via a first lumped parameter circuit, a stub between the forward portion and the backward portion configured to shunt the forward portion and the backward portion, and a conductor in parallel to the first lumped parameter circuit comprising a first end and a second end, with the first end being connected between the stub and the ground point, and the second end being open, wherein an electrical length from the feeding point to the ground point via the folded monopole antenna is equal to or near ½ a wavelength of a first resonant frequency, and an electrical length from the feeding point to the second end of the conductor via the forward portion, the stub, and the backward portion is equal to or near an integer multiple of ¼ a wavelength of a second resonant frequency.

11. The device of claim 10, wherein each of the forward portion and backward portion is folded.

12. The device of claim 10, further comprising:

a second lumped parameter circuit connected between the ground point and the second end of the conductor.

13. The device of claim 12, wherein an impedance of the second lumped parameter circuit is variable.

14. The device of claim 10, further comprising:

lumped parameter elements; and a switching circuit between the ground point and the second end of the conductor in order to selectively connect the lumped parameter elements.

15. The device of claim 14, wherein each of the lumped parameter elements comprises at least two of a capacitor, an inductor, a 0Ω resistor, and an open circuit.

16. The device of claim 14, wherein each of the lumped parameter elements comprises at least a first element and a second element wherein the first element and the second element are different.

17. The device of claim 10, further comprising:

a second antenna element comprising one end and another end, wherein the one end is connected between the stub and the ground point and the other end is open near the folded monopole.

18. The device of claim 17, wherein the second antenna element is placed such that a distance between the other end and a connection point between the forward portion and the backward portion is not more than 1/60 the wavelength of the second resonant frequency.

* * * * *